US007327978B2

(12) United States Patent
de Jong et al.

(10) Patent No.: US 7,327,978 B2
(45) Date of Patent: Feb. 5, 2008

(54) HEAT PIPE FUSING MEMBER

(75) Inventors: Jeremy Christopher de Jong, Webster, NY (US); David H. Pan, Rochester, NY (US); Osman Todd Polatkan, Hawthorne, NJ (US); Gerald A. Domoto, Briarcliff Manor, NY (US); Donald M. Bott, Rochester, NY (US); Nicholas P. Kladlas, Flushing, NY (US)

(73) Assignee: Xerox Corporation, Norwalk, CT (US)

( * ) Notice: Subject to any disclaimer, the term of this patent is extended or adjusted under 35 U.S.C. 154(b) by 132 days.

(21) Appl. No.: 11/170,262

(22) Filed: Jun. 29, 2005

(65) Prior Publication Data

US 2007/0003335 A1 Jan. 4, 2007

(51) Int. Cl.
*G03G 15/20* (2006.01)

(52) U.S. Cl. ..... 399/320; 399/328; 399/330; 399/333

(58) Field of Classification Search ..... 399/328
See application file for complete search history.

(56) References Cited

U.S. PATENT DOCUMENTS 5,426,495 A * 6/1995 Sawamura et al. ..... 399/331
5,596,397 A 1/1997 Shimada et al.
5,773,796 A 6/1998 Singer et al.
RE36,124 E 3/1999 Yokoyama et al.
5,984,848 A 11/1999 Hyllberg et al.
6,100,508 A 8/2000 Kubik
6,293,014 B1 9/2001 Kitazawa et al.
6,339,211 B1 1/2002 Foote et al.
6,445,902 B1 9/2002 Hirst et al.
6,571,080 B2 * 5/2003 Lee et al. ..... 399/330
6,577,836 B2 6/2003 Yamashita et al.
6,580,895 B2 6/2003 Hirst et al.
6,584,294 B1 6/2003 Lauda et al.
6,628,917 B2 9/2003 Lee
6,665,504 B2 12/2003 Lee et al.
6,665,515 B2 12/2003 Lee
6,690,907 B2 2/2004 Lee
6,778,789 B2 8/2004 Cho et al.
6,792,239 B2 * 9/2004 Lee ..... 399/330
6,847,798 B2 1/2005 Cho et al.

* cited by examiner

*Primary Examiner*—David M. Gray
*Assistant Examiner*—David A Blackshire
(74) *Attorney, Agent, or Firm*—Fay Sharpe LLP

(57) ABSTRACT

A fusing member is formed from an evacuable inner tube with a cylindrical wall. The evacuable inner tube is inserted into an outer tube and the inner tube is pressurized to expand the inner tube such that the wall is in contact with the outer tube. An amount of a working fluid is then sealed within the inner tube at a below atmospheric pressure.

6 Claims, 4 Drawing Sheets

HEAT PIPE FUSING MEMBER

CROSS REFERENCE TO RELATED APPLICATIONS

The following applications, the disclosures of which are incorporated herein in their entireties by reference, relate to heat pipe fuser rolls:

U.S. application Ser. No. 11/094,441, filed Mar. 31, 2005, entitled "Self Pumping Heat Pipe Fuser Roll," by Gerald A. Domoto, et al.

U.S. application Ser. No. 11/094,423, filed Mar. 31, 2005, entitled "Heat Pipe Fuser Roll with Internal Coating," by Jeremy C. DeJong, et al.

U.S. application Ser. No. 10/975,680, filed Oct. 28, 2004, entitled "Fusing Assembly Having a Temperature Equalizing Device," by James A. Herley, et al.

U.S. application Ser. No. 10/972,813, filed Oct. 25, 2004, entitled "Fast Acting Fusing Method and Apparatus," by Gerald A. Domoto, et al.

U.S. application Ser. No. 10/948,318 filed Sep. 24, 2004, entitled "Systems and Methods for Induction Heating of a Heatable Fuser Member Using a Ferromagnetic Layer," by Gerald A. Domoto.

BACKGROUND

The exemplary embodiment relates to fusing. It finds particular application in conjunction with a fusing device for an electrophotographic image forming apparatus and will be described with particular reference thereto. However it will be appreciated that the device finds application in other fusing and curing systems, such as solid-ink transfix or fusing systems.

In typical electrophotographic image forming devices, such as copy machines and laser beam printers, a dry marking material, such as toner particles adhering triboelectrically to carrier granules, is used to create an image on a photoconductive surface which is then transferred to a substrate, such as paper. The toner image is generally fused to the substrate by applying heat and pressure to melt or otherwise fuse the dry marking material. The fusing device includes a fuser roll which fuses the toner onto the paper, and a pressure roll which presses the paper against the fuser roll. The fusing process generally serves two functions, namely to attach the image permanently to the sheet and to achieve a desired level of gloss.

Conventionally, heat sources such as halogen lamps have been used as heat sources for the fuser roll. The halogen lamp heats the surface of the fuser roll to a target temperature with radiant heat. Heat pipe fuser rolls, which use a heated working liquid to apply heat from within the fuser roll, can have advantages over radiant heated rolls in that they tend to provide a more even distribution of heat across the fuser roll surface.

To function efficiently, the interior of a heat pipe fuser roll is evacuated to a low vacuum and filled with the working liquid to ensure that substantially no air is present. A typical assembly process usually involves multiple steps, each step being performed by a manufacturer with the particular expertise and equipment necessary to complete the step. As a consequence, heat pipe fuser rolls are often shipped several times during their manufacture, adding considerably to their cost and preparation time. For example, a typical process begins with the fabrication of a heat pipe by a heat pipe vendor, which is evacuated to about negative 3 Torr and sealed before shipping to an imaging device vendor. The imaging device vendor may machine the surface of the heat pipe to meet specifications. A fuser coating or number of coatings may be applied to the exterior of the heat pipe. After forming the surface layer, the assembled fuser roll is returned to the heat pipe vendor for backfilling with a working liquid, such as water. Because of the high temperatures used in forming the conformable surface layer, the water would burst the heating pipe if introduced before the coating is formed. Accordingly, the surface layer forming stage is performed with the heat pipe under vacuum.

INCORPORATION BY REFERENCE

U.S. Pat. No. 6,571,080 to Lee, et al. discloses a fuser roll assembly including a fuser roll that serves as a heat pipe, and a resistance heater or a halogen lamp inside the fuser roll, so that the surface of the fuser roll can be instantaneously heated up to a target fusing temperature. The entire disclosure of the U.S. Pat. No. 6,571,080 is incorporated herein by reference.

U.S. Patent Application No. 2002/0141795 to Hirst, et al. discloses a fusing system which includes a fuser roller configured as a heat pipe including an inner tube and a coaxial outer tube that is mounted to the inner tube, the inner and outer tubes defining an interior space therebetween that is adapted to contain a liquid and to be evacuated so as be maintained in a vacuum. The entire disclosure of the 2002/0141795 patent application is incorporated herein by reference.

BRIEF DESCRIPTION

Aspects of the exemplary embodiment relate to a fusing member, to a xerographic system, and to a method of forming a fusing member. In one aspect, the fusing member includes an inner tube in the form of a heat pipe which is sealed to define an evacuated interior chamber containing an amount of a working liquid and a coaxial outer tube in thermal contact with the inner tube along an outer surface of the inner tube.

In another aspect, a xerographic system includes a marking device which applies a marking, material to a substrate. A fusing device receives the marked substrate from the marking device. The fusing device includes a fusing member which comprises an outer tube and an inner tube at least partially within the outer tube. The inner tube is in direct contact with the outer tube for transferring heat thereto. The inner tube is sealed to define an interior chamber which holds a working liquid. A heater heats the working liquid. A pressure roll is in contact with the fusing member.

In another aspect, a method for forming a fusing device includes forming an evacuable inner tube with a cylindrical wall, inserting the evacuable inner tube into an outer tube, pressurizing the inner tube to expand the inner tube such that the wall is in contact with the outer tube, and sealing an amount of a working fluid in the inner tube at a below atmospheric pressure.

DETAILED DESCRIPTION

Aspects of the exemplary embodiment relate to a fusing member, to a fusing device comprising the fusing member, and to a method of forming, the fusing member. The fusing member includes a heat pipe which may be formed separately from and then installed within a preformed rigid cylindrical roller which supports appropriate fusing release materials on its outer surface. The heat pipe may be expanded in place to make thermal contact with the rigid cylindrical roller and filled with a working fluid at sub-atmospheric pressure. The fusing member may be incorporated into a xerographic imaging system for fusing images to substrate.

Figure 1:
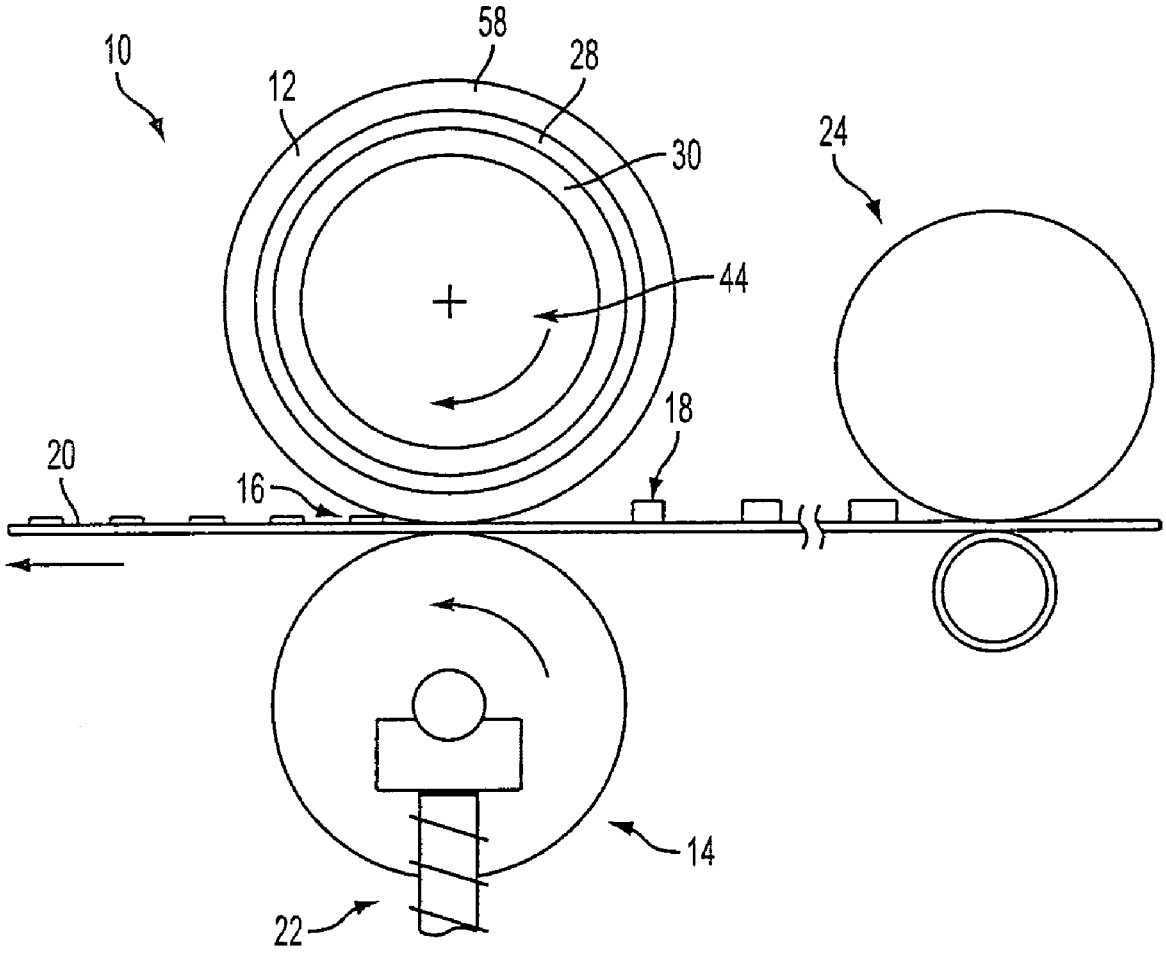
FIG. 1 is a schematic view of a xerographic system incorporating a fusing device according to an aspect of the exemplary embodiment.

With reference to FIG. 1, a xerographic imaging system including a fusing device 10 is shown schematically. The fusing device includes a fusing member or fuser roll 12 and a pressure roll 14 which define a nip 16 therebetween. The rolls are rotated, in the direction of the arrows shown, to fuse an image comprising toner particles 18 to a flexible substrate 20, such as paper, passing through the nip. The pressure roll 14 is biased towards the fuser roll by a loading member 22. The toner image may be formed by a marking device 24, upstream of the fusing device 10, using conventional xerographic processes. In general, the marking device 24 includes xerographic subsystems which are capable of forming an image on the substrate. Such subsystems may include a charge retentive surface, such as a photoconductor belt or drum, a charging station for each of the marking materials, such as toner colors to be applied, an image input device which forms a latent image on the photoreceptor, and a toner developing station associated with each charging station for developing the latent image formed on the surface of the photoreceptor by applying a toner to obtain a toner image. A pretransfer charging unit charges the developed latent image. A transferring unit transfers the toner image thus formed to the surface of the substrate 20.

Figure 2:
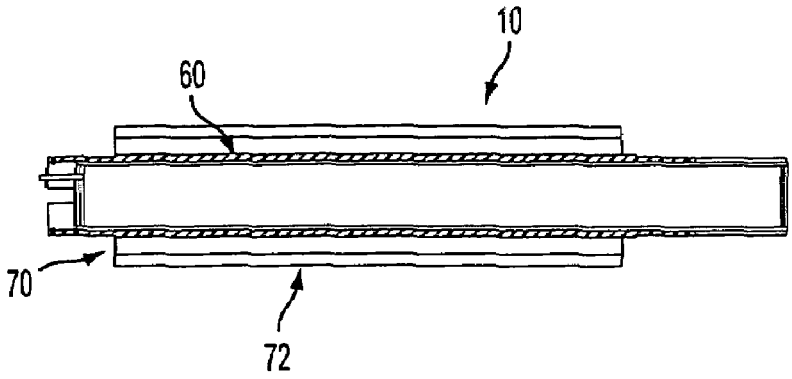
FIG. 2 is a side sectional view of the fuser roll of the fusing device of FIG. 1.
Figure 3:
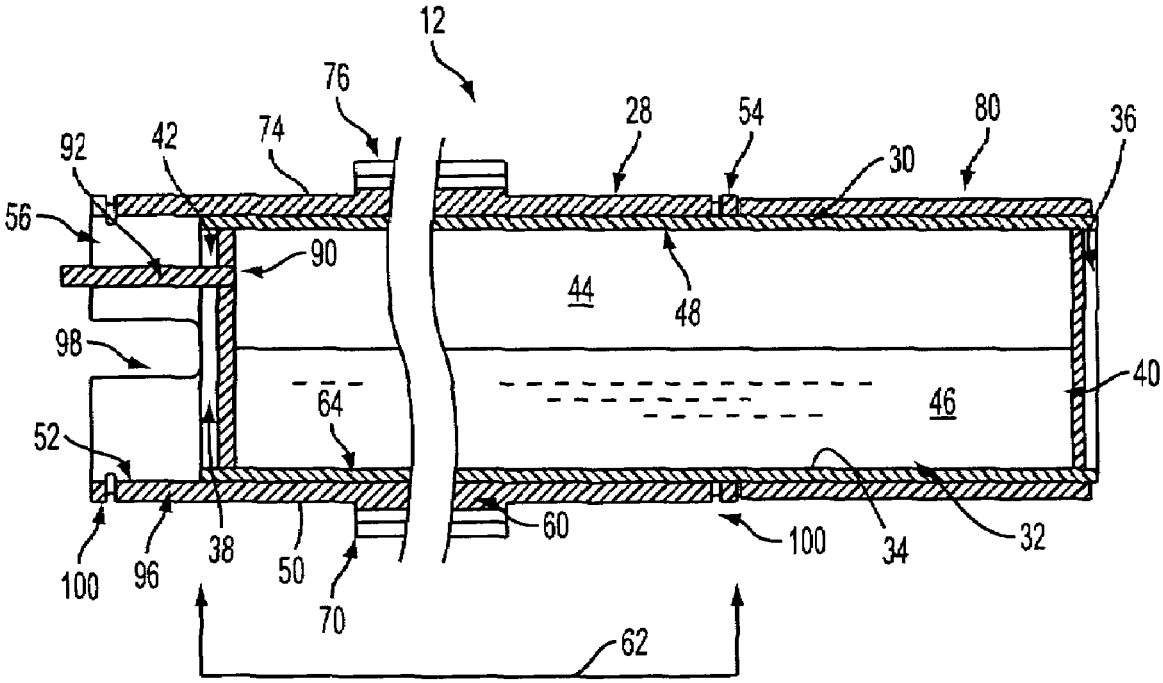
FIG. 3 is an enlarged side sectional view of the fuser roll of FIG. 2.
Figure 4:
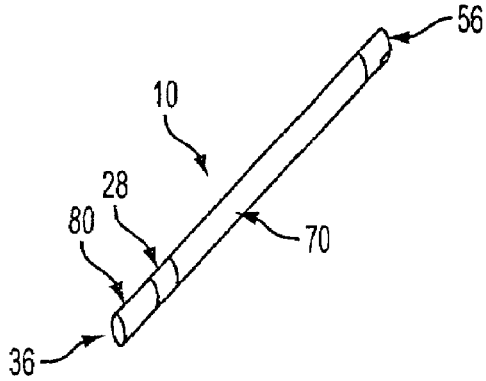
FIG. 4 is a perspective view of the fuser roll of FIG. 2.

With reference to FIGS. 2-4, in one aspect, the fuser roll 12 includes a rigid cylindrical roller 28 which defines an outer tube of the fuser roll 12 and a heat pipe 30 which defines an inner tube 32 of the fuser roll 12. The inner tube 32 includes a generally cylindrical wall 34, which is closed at opposed first and second ends 36, 38 thereof by end caps 40, 42 to define an interior chamber 44. Sealed within the heat pipe chamber 44 is a predetermined amount working fluid 46. The working fluid can be aqueous, such as water, or an organic liquid, such as an alcohol or glycol, e.g., ethanol or ethylene glycol, or combinations thereof. At ambient temperatures(about 20-30° C.), the working fluid can be in the form of a liquid which generally occupies only a portion of the chamber 44, for example, about 5-50% with respect to a volume of the chamber 44. The remainder of the chamber volume is evacuated to below atmospheric pressure such that when heated, the working liquid is in equilibrium with its vapor and substantially no air is present. The inner tube 32 can be formed of stainless steel, aluminum, copper, nickel, or alloys thereof, such as a copper-nickel alloy. The choice of working fluid 46 depends in part on the material of the inner tube 32. In the case of a stainless steel heat pipe, most known fluids, excluding water, may be used as the working fluid 46. Where the material of the heat pipe inner tube 32 is copper, most known fluids including water may be used. Optionally, a coating (not shown) such as nickel is provided on an interior surface 48 of the wall 34.

As shown in FIG. 3, the heat pipe 30 is surrounded, along at least a part of the length of the wall 34, by the cylindrical roller 28 and is generally coaxial therewith. The cylindrical roller 28 has an outer surface 50 and an inner surface 52 and first and second open ends 54, 56. The inner surface 52 is in thermal contact with an outer surface 58 of the heat pipe wall 34. Heat transferred from the working fluid to the heat pipe wall 34 is thus conducted to the cylindrical roller 28. The roller 28 defines a widened portion 60 between ends 54, 56 which comprises the working region of the cylindrical roller 28. An area of direct physical contact 62 between the wall 34 and the roller 28 extends along a substantial portion of an axial length of the cylindrical roller and includes an area 64 adjacent the widened portion 60. In the illustrated embodiment, the area of contact 62 extends beyond the widened portion 60 to the first end 38 of the heat pipe in one direction and to the end 54 of the roller 28 in the opposite direction.

The cylindrical roller 28 can be formed of stainless steel, aluminum, copper or alloys thereof. The outer surface 50 of the cylindrical roller 28 is coated with one or more layers to form a fusing release member 70 in the widened portion 60. Member 70 has an outer surface 72 which contacts the substrate 20 to fuse the toner particles 18 thereon. The conformable member 70 may include an inner conformable layer 74 and an outer fusing release layer 76. Suitable polymers for forming the outer fusing release layer 76 of the fuser member include fluoropolymers, such as polytetrafluoroethylene (PTFE, e.g., TEFLON™), fluorinated ethylenepropylene copolymer (FEP), perfluorovinylalkylether tetrafluoroethylene copolymer (e.g., PFA TEFLON™), polyethersulfone, copolymers and terpolymers thereof, and the like. One or more of such layers 76 may be employed. The layer 76 of TEFLON can have a thickness of about 0.03 to 0.05 mm. Layer 74 may be formed of a conformable material, such as silicone rubber, and may be located between roller 28 and the outer fusing layer 76. Numerous other fuser roll coatings are also contemplated, including silicones, fluoroelastomers, and fluorosilicones, and others known in the art.

A heater 80 is in thermal contact with the wall 34. The heater can provide heat by any suitable means, such as by resistive heating, induction heating, or radiative heating. In the illustrated embodiment, the heater includes a heating collar which extends from adjacent the first end 30 of the heat pipe and abuts the end 54 of roller 28 at an inner end thereof. The heating collar 80 is connected with a heat source (not shown), such as an electrical power source. The heating collar 80 heats the wall 34 of the heat pipe 30 which in turn heats the working fluid 46. The working fluid 46 is vaporized by heat of the heater 80 and serves as a thermal medium which transfers the heat to the wall 34 and mediates a temperature deviation on the surface of the cylindrical roller 28, and heats the overall cylindrical roller 28 within a short time. The heat of the cylindrical roller 28 is transferred to the fuser roll surface 76, and then fuses the toner 18, which is in a powder state formed on the paper 20.

The temperature of the surface of the fuser roll layer 76, which contacts the surface of the paper 20 onto which a toner image has been transferred, is generally maintained at a temperature of about 120-220° C.

The end cap 42 includes a fill port 90 used for evacuating and filling the chamber 44. The fill port 90 is sealed after filling with the working fluid, for example, with a plug 92. The cylindrical roller 28 includes an end portion 96 which extends beyond the second end 38 of the heat pipe 30, and serves as a gear for engaging a gear of a drive member (not shown) which rotates the cylindrical roller. To this end, a slot 98 of the end portion is shaped to receive the drive gear. At least one bearing groove 100 adjacent the first end 54 of the roller 28 is supported by a bearing (not shown). A thermistor (not shown) measures the surface temperature of the fuser roll 12 and a controller (not shown) maintains the surface temperature of the fuser roll within a predetermined range suitable for fusing the toner 18 onto the paper 20. If the surface temperature exceeds a predetermined maximum or increases too rapidly, the thermistor may cut off power to the heater 80.

Figure 5:
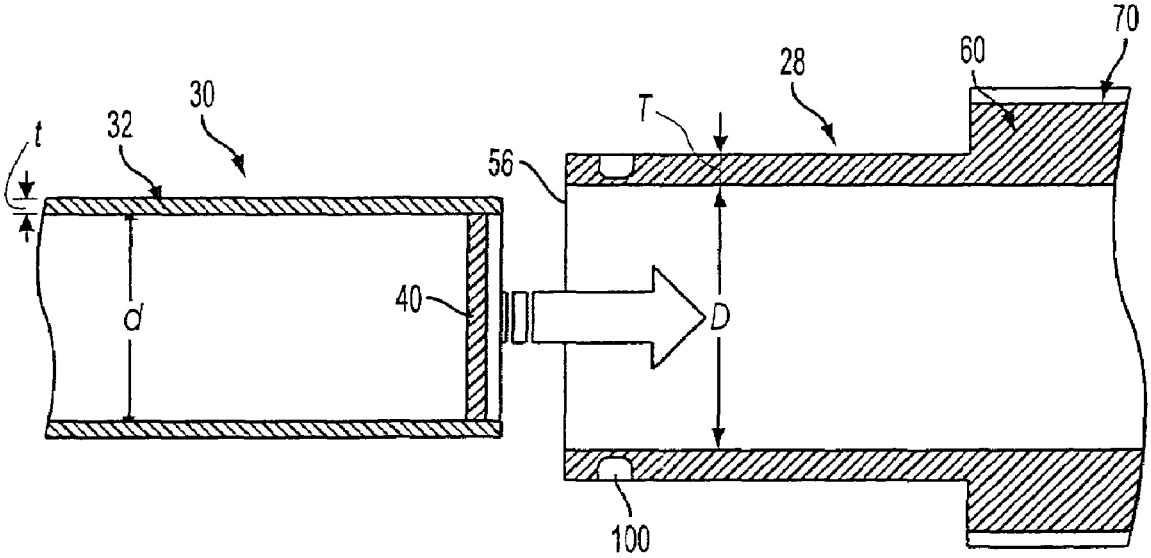
FIGS. 5 and 6 illustrate steps in an exemplary method of forming the fuser roll of FIGS. 2-4.
Figure 6:
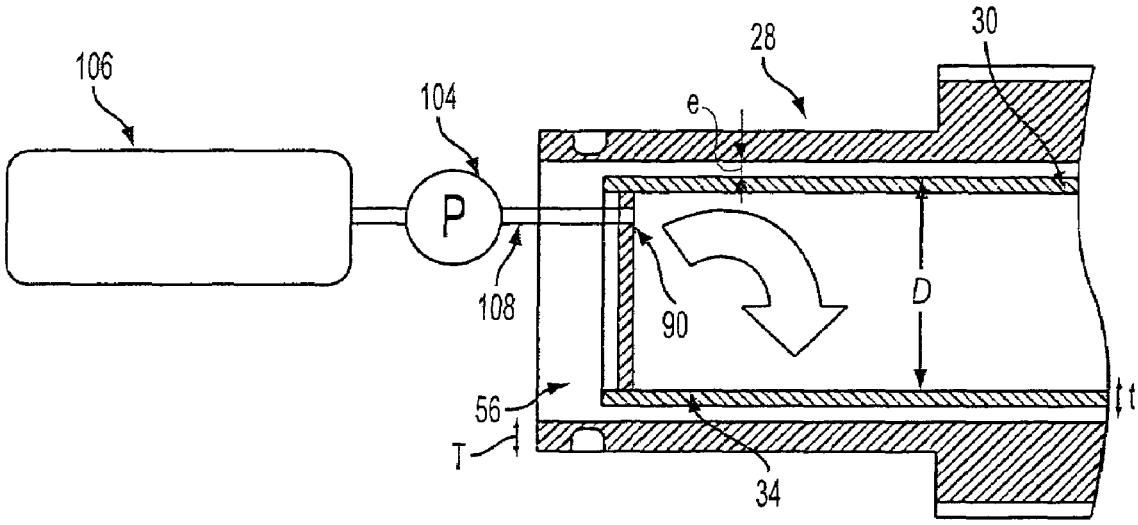

A method of forming the fuser roll 12 is illustrated in FIGS. 5 and 6. The method includes forming the heat pipe 30 with an outer diameter d which is slightly less than an interior diameter D of a preformed cylindrical roller 28 (FIG. 5). To reduce the production time of the fuser roll 12, the heat pipe inner tube 32 can be formed by a heat pipe manufacturer at the same time as the cylindrical roller 28 and its conformable member 70 are being formed elsewhere. Prior to assembly, the preformed roller 28 is machined to provide the widened portion 60 and bearing groove(s) 100 and has the conformable member 70 attached thereto. For example, a layer of adhesive is laid down on the widened portion 60 and a silicone rubber member 74 is attached thereto. A TEFLON™ coating 76 is then fused to the silicone rubber surface by heating the roller 28 to a high temperature, for example at least about 370° C.

The preformed inner tube 32 is inserted into the preformed cylindrical roller 28, optionally with the heating collar 80 abutting the roller 28. In one embodiment, an expansion fluid under pressure is introduced to the chamber through the fill port 90. The expansion fluid may be a liquid and/or gas, such as the working fluid, in liquid and/or vapor form, a gas, such as air, oxygen, nitrogen, inert gas, or combination thereof. The pressure of the expansion fluid is sufficient to cause the diameter d of the heat pipe to expand, relative to that of the roller, until the heat pipe is in contact with the interior surface 52 of the roller 28 and the heating collar 80. In general, the expansion of the heat pipe causes the wall 34 of the heat pipe inner tube 32 to exceed its elastic limit, such that it yields and conforms outward. When the pressure is reduced, the heat pipe 30 retains its enlarged diameter and maintains a good thermal contact with the roller 50 and heating collar 70.

The radial expansion e of wall 34 (FIG. 6) can be relatively small, just sufficient to provide good thermal contact between the wall 34 and the roller 28, for example, e can be less than about 2 mm and in one embodiment, less than about 1.5 mm. In one embodiment, the radial expansion e of wall 34 is at least about 0.05 mm, in one specific embodiment, at least 0.2 mm, and in another specific embodiment, at least 0.8 mm. These values of e can be considered as being expansions of the wall 34 relative to the expansion of roller 28. In general, however, the roller does not expand, or only minimally so. The minimum expansion depends, to some degree on the smoothness of the tubes 28, 34 and should be sufficient to allow the wall 34 to slide smoothly into the roller 28. The roller 28 is sufficiently rigid to withstand the pressure of the expanding heat pipe 30. The roller 28 thus has a higher yield strength, at the applied pressure, than the wall 34. If the heat pipe wall 34 is formed from the same material as the rigid roller 28, such as copper, it generally has a lower thickness t than the thickness T of the roller 28 since the yield strength of the tube depends on the wall thickness and the Young's modulus of the material from which it is formed.

In the embodiment illustrated in FIG. 6, a source of pressure, such as a pump 104, pumps the liquid working fluid and/or other expansion fluid from a reservoir 106, such as a cylinder, into the port 90 via an injection passage 108. The hydrostatic pressure causes expansion of the heat pipe wall 34. Once the wall has expanded, the hydrostatic pressure is reduced and the wall 34 retains its position, gripping the roller 28 and collar 80 tightly. The chamber 44 may then be evacuated to provide a high vacuum, such as about 1 Torr, or less. The desired amount of working liquid is injected into the interior chamber 44. The chamber 44 is thus maintained under a vacuum, at least in the ambient temperature range. Once evacuation and filling has been completed, the chamber is sealed, for example with the plug 92 or by other suitable means, such as by crimping the port 90 or by welding or brazing it shut.

In an alternative embodiment, the working fluid 46 may be introduced to the heat pipe inner tube 32 and the fill port 90 sealed, e.g., with the plug 92, all prior to insertion of the heat pipe 30 into the roller 28. After insertion, the heat pipe 30 is heated to a sufficient temperature for the vapor pressure within the heat pipe to cause the wall 34 to expand. The heating can be performed with the heating collar 80 or by other means, such as by placing the fuser roll 12 in an oven at an appropriate temperature.

Figure 7:
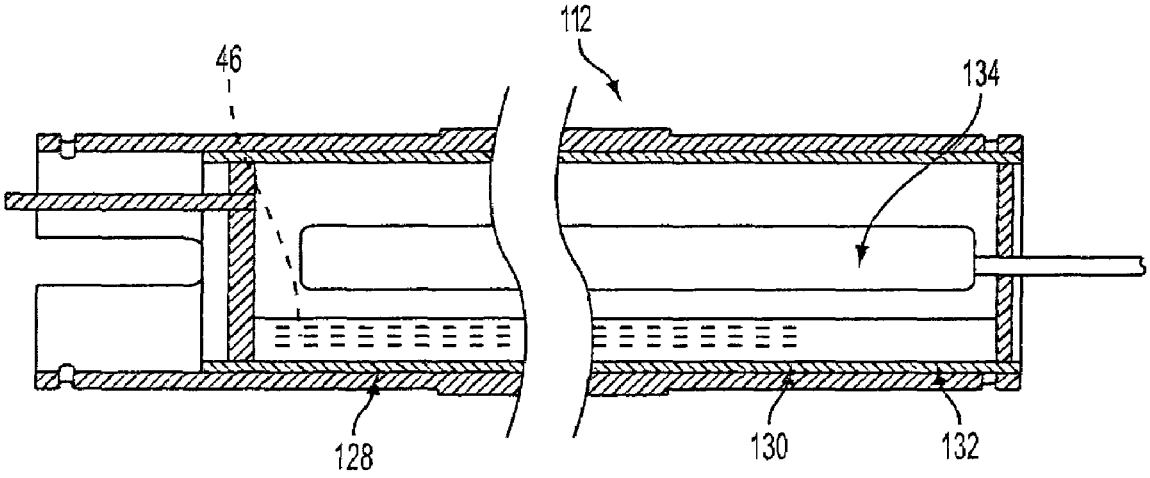
FIG. 7 is a side sectional view of a fuser roll according to another aspect of the exemplary embodiment.

With reference now to FIG. 7, a fuser roll 112 according to a second aspect is shown. The fuser roll is similarly configured to that of FIGS. 2-4 except as noted. The fuser roll 112 includes a rigid roller 128 and a heat pipe 130 comprising an elongate tube 132 in direct contact with the rigid roller. The heat pipe 130 can be shorter than that used for the embodiment of FIGS. 2-4, since there is no external heating collar. In place of a heating collar, a heating rod 134 is placed within the heat pipe 130 and may extend along the axial length of the heat pipe 130. The heating rod 134 may be connected with an external heat source, as previously described, or may contain a heat source therein, such as a halogen lamp or lamps.

An exemplary heat pipe can be formed from a copper cylinder for the wall 34, which may be nickel plated. The nickel aids in brazing the end caps 40, 42 to the cylindrical wall 34. The end caps 40, 42 may be formed from copper. While the wall 34 expands under the expansion pressure, the end caps 40, 42 need not do, and thus may have a higher yield strength than the wall 34. In one embodiment, the wall 36 is about 0.5 mm to about 1.2 mm in thickness, e.g., about 0.8 mm. The copper end caps may have a higher thickness, such as about 1-5 mm. The wall 34 may have an outside diameter d, prior to expansion, of from about 1 to about 5 cm, e.g., about 1.5 to 3 cm. For example, the outside diameter may be about 2.22 cm and inside diameter, about 1.99 cm. The expansion may be less than about 2 mm, e.g., about 1 mm, or less. The roller may have a wall thickness of about 1-5 mm.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for forming a fusing device comprising:

forming an evacuable inner tube with a cylindrical wall;

inserting the evacuable inner tube into an outer tube;

inserting the inner tube into a heating collar;

pressurizing the inner tube to expand the inner tube such that the wall is in direct physical contact with the outer tube, the pressurizing of the inner tube expanding the inner tube such that a first portion of the wall of the inner tube is in contact with the heating collar and a second portion of the wall of the inner tube, axially spaced from the first portion, is in contact with the outer tube; and sealing an amount of a working fluid in the inner tube at a pressure which is below atmospheric pressure.

2. The method of claim 1, wherein the cylindrical wall has a lower yield strength than the outer tube, such that the cylindrical wall maintains contact with the heat pipe after the pressurizing.

3. The method of claim 1, wherein the method further comprises mounting a layer of a fusing release material to an outer surface of the outer tube.

4. The method of claim 3, wherein the fusing release material is mounted to the outer tube prior to pressurizing the inner tube.

5. The method of claim 1, wherein the inner tube comprises an evacuation port and the pressurizing comprises applying pressure to an expansion fluid within the inner tube via the evacuation port.

6. A fusing device formed by the method of claim 1.

* * * * *

UNITED STATES PATENT AND TRADEMARK OFFICE

CERTIFICATE OF CORRECTION

PATENT NO. : 7,327,978 B2
APPLICATION NO. : 11/170262
DATED : February 5, 2008
INVENTOR(S) : de Jong et al.

It is certified that error appears in the above-identified patent and that said Letters Patent is hereby corrected as shown below:

Title page, item (73) the sixth/last inventor's name should read Nicholas P. Kladius Signed and Sealed this Twenty-fourth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,327,978 B2
APPLICATION NO. : 11/170262
DATED : February 5, 2008
INVENTOR(S) : de Jong et al.

It is certified that error appears in the above-identified patent and that said Letters Patent is hereby corrected as shown below:

(75) the sixth/last inventor's name should read Nicholas P. Kladias

Signed and Sealed this

Twenty-third Day of September, 2008

JON W. DUDAS
*Director of the United States Patent and Trademark Office*